United States Patent [19]

Nelson

[11] 4,365,438

[45] Dec. 28, 1982

[54] COMBINATION TOY AND BOOK

[76] Inventor: Herman E. Nelson, 3618 Chateau Knoll, Bettendorf, Iowa 52722

[21] Appl. No.: 236,875

[22] Filed: Feb. 23, 1981

[51] Int. Cl.[3] ..... A63H 11/10; A63H 33/00; B65D 73/00; G09F 3/18

[52] U.S. Cl. ..... 46/202; 46/11; 46/36; 206/472; 40/10 D

[58] Field of Search ..... 426/104; 46/1 R, 201, 46/202, 11, 206, 35–37; 206/475, 474, 473, 472; 40/158 R, 152, 154, 124.4, 152.1, 155, 10 D; 229/8; 281/39, 38

[56] References Cited

U.S. PATENT DOCUMENTS

| | | | |
|---|---|---|---|
| 1,490,295 | 4/1924 | Stephens | 46/36 |
| 1,709,937 | 4/1929 | Everard | 206/472 |
| 2,874,707 | 2/1959 | Koppel | 206/472 |
| 3,191,319 | 6/1965 | Waisgerber | 206/472 |
| 3,206,887 | 9/1965 | Eyler et al. | 46/202 |
| 3,414,296 | 12/1968 | Schneider | 281/39 |
| 3,810,566 | 5/1974 | Adams et al. | 40/158 R |
| 4,203,516 | 5/1980 | Stonoga et al. | 206/472 |

*Primary Examiner*—Robert Peshock
*Assistant Examiner*—Michael J. Foycik, Jr.

[57] ABSTRACT

A combination toy vehicle and book, which also serves as a container for the toy, is formed by imprinting a multiplicity of uniformly sized pages with scenes upon which a user may operate the toy vehicle. By cutting out an identical region of each page, and by binding the pages together along one side, a book is formed which contains a well in which the toy vehicle may be stored. The inventive device may also serve as a marketing package by inserting a toy vehicle in the well formed by the cut-out regions, and by covering at least the well formed by the cut-out regions of the book with a transparent sheet or bubble.

8 Claims, 5 Drawing Figures

COMBINATION TOY AND BOOK

BACKGROUND OF THE INVENTION

This invention relates to combination devices, especially for children and more particularly to books which serve as a toy, a packaging device for the toy, and a background device which is usable with the toy. The book may also serve as a storage device for the toy when neither the book nor the toy is in use.

Heretofore, toys, especially toy vehicles, have often been used primarily by running them along a surface, thereby providing entertainment to the user. While users can run toy vehicles independently of any specific track or similar structure, some toy vehicles are designed to be used in connection with specific 3-dimensional structures such as race tracks, which are often sold separately and are quite expensive. Also available are 3-dimensional toy garages, filling stations, or a variety of other often expensive structures which may be used with the toy vehicle. Toy vehicles are usually sold independently of any other toy, and are usually packaged either in boxes or upon blister cards, most of which are promptly discarded.

Accordingly, an object of the invention is to provide a device which incorporates a number of different illustrated scenes or gameboards upon which a toy vehicle can be run, which is also relatively inexpensive, and which provides both a place to store the toy vehicle when not in use, and a packaging means in which to market the toy vehicle.

A further object of this invention is to provide a relatively inexpensive toy which incorporates a variety of illustrated scenes and games, upon which a user may operate a toy vehicle. A still further object of this invention is to provide a useful and distinctive marketing package for a combination toy and book and for toy vehicles sold in association with the combination toy and book.

Another object of this invention is to provide a storage space for the toy vehicle when the combination toy and book and the associated toy vehicle is not in use.

SUMMARY OF THE INVENTION

In one form, the invention includes a book having a multiplicity of uniformly sized pages, each of which is imprinted with a different illustrated scene or game. In an alternative form the invention includes pages which are imprinted with a portion of a scene and when bound together into a book, facing pages make up a complete scene or game.

Each of the pages, printed in either form, contains a cut-out area, which is dimensioned and positioned uniformly on each page. The front cover of the resulting book may have a cut-out area at a position corresponding to the cut-outs in each page of the book, so that a toy vehicle may be positioned within a well or housing formed by the cut-outs and yet be visable when the cover is closed on the book. The back cover would contain no cut-out area, thereby providing a base for the well in which the toy would be placed.

The toy vehicle, positioned in the resulting housing or well formed by the cut-out areas, may be covered by a clear plastic bubble for securing the vehicle to the inside back cover. In the alternative, the toy vehicle may be placed in the cut-out well and the entire combination of toy and book may be shrink wrapped in a sealed package. In still another embodiment, the bubble may be hinged to the book so that it may be opened or closed to remove or replace the toy. By any of these similar methods, the toy vehicle is visable to one who is viewing the combination toy and book, which is attractively packaged for sale.

BRIEF DESCRIPTION OF THE DRAWINGS

Other objects will be apparent from the description, claims and drawings, wherein:

and

Figure 4A:
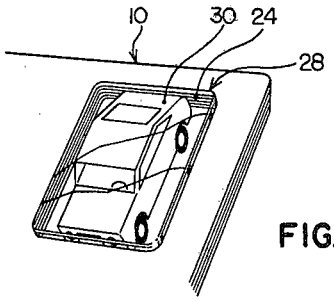
FIG. 4A is a fragmentary, front plan view of the device showing a toy vehicle enclosed under a bubble in a well of the device.
Figure 4B:
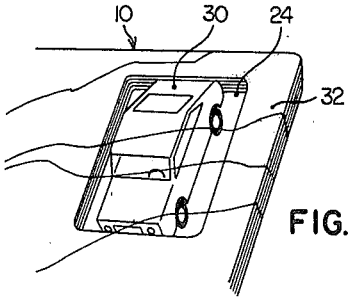

FIG. 4B is a fragmentary, front plan view of the device showing it covered with a transparent plastic sheet.

DESCRIPTION OF A PREFERRED EMBODIMENT

Figure 1:
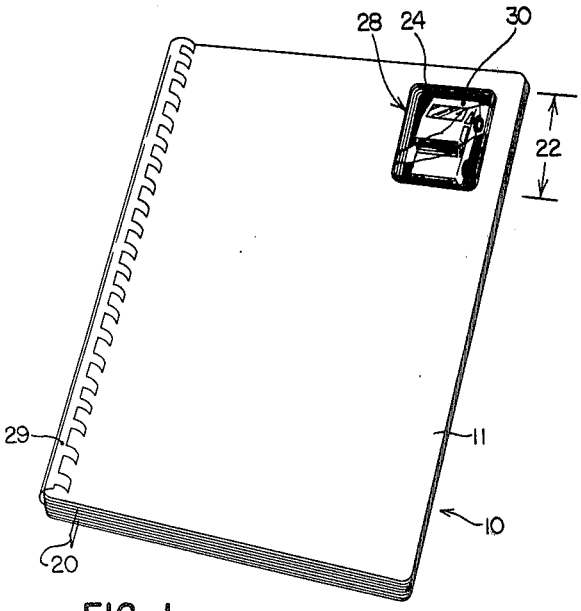
FIG. 1 is a perspective view of a preferred embodiment of the assembled and closed book or other device with a toy vehicle enclosed in a plastic bubble.

FIG. 1 shows the combination toy and book 10, which may be formed by binding together front 11 and back 12, preferably hard covers, plus any suitable number of pages members 20. The front cover 11 and each of the pages 20 contain a cut-out region 22 which align to form a housing or well 24 when the book 10 is closed. FIG. 1 also shows a toy 30 which is in well 24 and is covered by a transparent plastic bubble 28. A suitable binding 29 assembles the covers and pages, in a book form.

Figure 2:
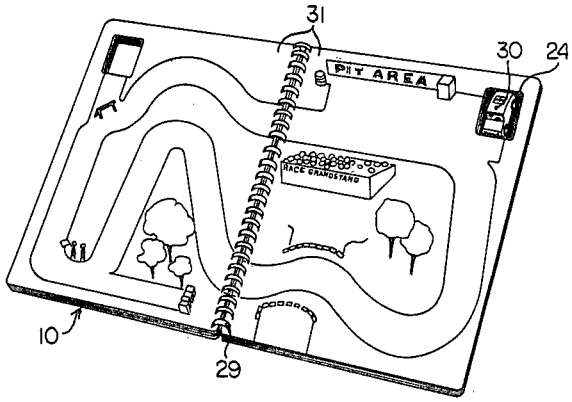
FIG. 2 is a top plan view of the assembled and open book or other device.

FIG. 2 shows the open book of the combination toy and book 10 and a corresponding relationship between scenes printed on facing pages of the book 10. The toy vehicle 30 remains stored in well 24.

Figure 3:
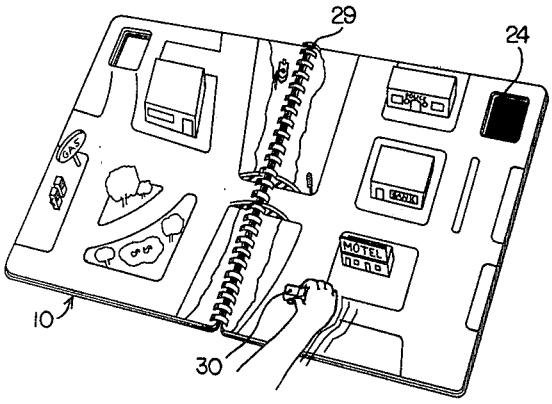
FIG. 3 is a perspective view of the book or other device showing a toy vehicle, as it is actually being used on the device.

FIG. 3 also shows the open book of the combination toy and book 10, with the toy vehicle 30 out of the well 24 and in use by a child who is running it on the scenes printed on pages of the book 10.

FIG. 4A shows one embodiment of the book 10 which incorporates a transparent bubble or blister 28 covering only the toy 30 within the well 24. This bubble may be hinged to the back cover so that it may be repeatedly opened and closed to remove or store the toy 30. The hinged bubble may also be imprinted with the appearance of a garage, firehouse, or the like.

FIG. 4B shows the book 10 and toy 30 wrapped in a transparent plastic sheet 32 which is preferably shrunk over the combination.

The pages of the book 10 are preferably made from a heavy stock material which is durable and imprinted with a scene or maze type game containing roadways, buildings or any other suitable type of figure. Each page should be sturdy enough so that a child pressing the toy against the page, will not damage it.

The specific scenes may be imprinted upon both sides of the page. The scene may be designed to correspond to and coordinate with another scene on the facing page of the bound book 10 so that an entire scene consists of both a pair of facing pages, in the bound book 10. While, each page is preferably made of a thick stock having a suitable offset of silk screen printing, the pages may also be imprinted with scenes on a thin stock which is then pasted or otherwise bonded over a heavier stock. Preferably, the print of each page is covered with a plastic coating to give a more indestructible, mar resistant surface. This plastic coating may be vacuum formed to give a three dimensional surface effect to the pages so that (for example) the curbs are raised while the streets are depressed. To further increase the durability of such a vacuum formed surface, the resulting rear cavities may be filled with any suitable material, such as plastic foam, for example. Of course, other techniques may also be used to provide three dimensional surfaces.

A uniform and correspondingly positioned region on each page is die-cut to provide in each of the pages, a similar and correspondingly aligned cut-out area.

The pages may be bound together by a spiral or ring binder 29 or by other suitable binding means. A spiral binder is thought to be most desirable since it is inexpensive and opens flat. Yet, it keeps the facing pages relatively close to and well aligned with each other, thereby preserving the continuity of the scenes on the facing pages. However, other binding methods may also be used. The best method may be determined from considerations of cost, packaging, shipping or storage, and the like.

The front cover of the book used may also contain a cut-out region, corresponding to the cut-outs in the pages. The cut-out in the front cover of the book is useful for displaying the toy vehicle at the point of purchase and may be covered by a transparent bubble suitably fixed in place. Or, a transparent sheet or wrap may cover the entire book and toy.

When the book has an unbroken cover which extends over the cut-out area, the invention also becomes especially useful as a storage box for this toy vehicle, when neither the book nor the toy is in use. The inventive device may also serve as its own marketing package as well as the marketing package, for toy vehicles stored in the well.

Those who are skilled in the area will perceive how modifications may be made in the disclosed structure. Therefore, the appended claims are to be construed to cover all equivalent structures which may fall within the true scope and spirit of the invention.

I claim:

1. A combination toy article comprising a removable three dimensional toy vehicle having at least one rotatable supporting wheel and a book having a plurality of relatively heavy pages, each of said pages containing graphic material in the form of a different illustrated scene or game, each of said pages further containing a cut-out region which cooperates with said scene or game and which aligns with all other cut-out regions to form a well at least large enough to completely receive and contain said three dimensional toy vehicle when the book is closed, means for binding each of said pages along one edge such that when bound together said cut-out regions cooperate to form said well in the book with said removable three dimensional toy means completely housed within said well, the pages having said graphic material formed thereon which cooperates with said toy to provide a playing surface, along which the toy means may be moved while being supported by said rotatable wheel.

2. The article of claim 1 wherein the book also has a front cover with a cut-out of equal or lesser size and corresponding to and aligning with the cut-out of each page.

3. The article of claim 2 and a transparent material covering the cut-out on the front cover to contain the toy.

4. The article of anyone of the claims 1 to 3 wherein the book well is adapted to serve as a package containing a toy at the time of purchase.

5. The article of anyone of the claims 1 to 3 wherein the book pages are strong enough to resist damage during normal play with said toy running on said graphic material and said pages are covered with a mar-resistant material.

6. The article of claim 5 wherein said mar-resistant material is a three-dimensional vacuum formed sheet.

7. The article of claim 2 and transparent bubble element hinged to said book in said cut-out means so that said bubble may be opened and closed to remove or to store said toy.

8. The article of claim 7 wherein said hinged bubble is imprinted to cooperate with said graphic material and playing surface.

* * * * *